US007137902B1

(12) United States Patent
Wright

(10) Patent No.: US 7,137,902 B1
(45) Date of Patent: Nov. 21, 2006

(54) SYSTEM FOR ALIGNING A GOLFER'S STANCE

(76) Inventor: David F. Wright, 31731 Via Coyote, Cota de Caza, CA (US) 92679

( * ) Notice: Subject to any disclaimer, the term of this patent is extended or adjusted under 35 U.S.C. 154(b) by 0 days.

(21) Appl. No.: 10/937,037

(22) Filed: Sep. 9, 2004

(51) Int. Cl.
*A63B 69/36* (2006.01)

(52) U.S. Cl. ..... 473/266; 473/207; 473/216; 473/277

(58) Field of Classification Search ..... 473/207, 473/212–116, 215, 216, 266–278; D21/791; 273/DIG. 30
See application file for complete search history.

(56) References Cited

U.S. PATENT DOCUMENTS 3,368,817 A * 2/1968 Duncan ..... 473/215
4,079,520 A 3/1978 Davis
4,231,576 A 11/1980 Perkins
4,482,155 A 11/1984 Higley
4,583,739 A 4/1986 Kabbany
4,657,258 A 4/1987 Melov et al.
4,688,800 A * 8/1987 Lopez ..... 473/215
4,871,175 A 10/1989 Levin et al.
4,927,151 A 5/1990 Ronnick
5,108,106 A 4/1992 Cook
5,171,017 A 12/1992 Betancourt
5,322,288 A 6/1994 Amis
5,338,037 A 8/1994 Toyohara
5,351,963 A 10/1994 Baek
5,397,121 A * 3/1995 Gipson et al. ..... 473/215
5,487,546 A 1/1996 Yasuda
5,492,328 A * 2/1996 Lundquist ..... 473/218
5,509,657 A 4/1996 Guthry
5,549,298 A 8/1996 Cullen et al.
5,569,095 A * 10/1996 McCollum ..... 473/215
5,643,097 A * 7/1997 Bechler et al. ..... 473/215
5,645,494 A * 7/1997 Dionne et al. ..... 473/278
5,658,203 A * 8/1997 Shub ..... 473/205
5,667,447 A 9/1997 Perham et al.
5,672,115 A 9/1997 Sanchez et al.
5,707,299 A 1/1998 McKenna
5,755,623 A 5/1998 Mizenko
5,797,809 A 8/1998 Hyuga
5,820,476 A 10/1998 Amato
5,820,493 A 10/1998 Price, Jr.
5,823,878 A 10/1998 Welch
5,885,167 A 3/1999 St. Martin
5,890,968 A * 4/1999 Mingo ..... 473/207
5,938,539 A 8/1999 Hamilton
5,984,801 A 11/1999 Mason
6,027,413 A 2/2000 Smith et al.
6,071,199 A 6/2000 Suzuki (Continued)

*Primary Examiner*—Nini F. Legesse
(74) *Attorney, Agent, or Firm*—Drummond & Duckworth

(57) ABSTRACT

An apparatus and methodology are provided for determining the proper set-up for a golfer. The methodology and apparatus set a golfer's hips parallel to his intended ball roll or flight line (target line) based upon his right or left hip rotation and shoulder width to determine his individualized stance address position to a golf ball. To this end, the apparatus includes a template "mat" placed on the ground which measures the width of a golfer's stance and rotation of a golfer's hips from the proposed path of the golf ball, also referred to as the "target line", and an elongate bar affixed to a golfer's hips for visually indicating the golfer's hip rotation relative to the target line. The mat preferably includes a plurality of markings for measuring the width of a golfer's stance and for measuring the rotation of a golfer's hips.

8 Claims, 13 Drawing Sheets

U.S. PATENT DOCUMENTS 6,077,169 A * 6/2000 Florian ..... 473/278

6,503,148 B1 * 1/2003 Lane ..... 473/215

* cited by examiner

SYSTEM FOR ALIGNING A GOLFER'S STANCE

BACKGROUND OF THE INVENTION

The present invention relates to golf set up, putting stroke and swing practice aids. More particularly, the present invention relates to tools and methods for adjusting a golfer's stance when addressing a golf ball. Even more specifically, the present invention provides an apparatus and methodology that assesses the left or right rotation of a golfer's hips from a square stance as a determination of the most desirable stance line for balance to putt or swing a golf club.

Golf is a game of skill requiring exact coordination in order for a player to bring a relatively small club face in proper contact with an even smaller golf ball. This applies to putting or full swing. Recently, much effort has been expended to improve golf scores by incorporating modern materials and manufacturing techniques into golf equipment. Furthermore, hundreds of modern training aids have been developed in an effort to characterize and refine the biomechanics of a golfer's swing.

Unfortunately, the training aids primarily are directed to training golfers to use the same conventional golf stance and golf swing, even though each golfer has a different physiology requiring different golf set-up. For example, conventional golf wisdom teaches a set-up to the golf ball where the golfer's feet, hips and shoulders are parallel to the intended line of ball roll or flight (target line.) This instruction standard is the same for all golfers. As but one example, the Professional Golfer's Association (PGA) of America Teaching Manual describes a stance where feet, knees, hips and shoulders are parallel left of the target line as the most sensible standard from which to begin with a student. The PGA manual further states that this parallel left set up may not be the best for the student to swing from and adjustments may be necessary due to various anatomical differences.

Similarly, a training aid to teach parallel left of target line for stance alignment, foot placement, ball position and a visual memory reference for aiming at a target is disclosed in U.S. Pat. No. 5,984,801. A similar disclosure is presented in U.S. Pat. No. 5,938,539 whereas a teaching aid assists a golfer in visually aligning their hips, thighs and shoulders producing a stance that is parallel to the target line. U.S. Pat. No. 5,322,288 describes a stance alignment device positioned on the ground between a golfer and his golf ball. A golf alignment device that aids a golfer in maintaining a perpendicular relationship to his target is disclosed in U.S. Pat. No. 5,549,298. A golfer's stance positioning device is disclosed in U.S. Pat. Nos. 4,583,739 and 5,171,017 wherein the golfer's feet are set on a line parallel to the target line. An alignment training device is also described in U.S. Pat. No. 4,871,175. The device is used to set the golfer's body and foot position in reference to a guide upon which the golfer aligns his swing. U.S. Pat. No. 4,657,258 describes a practice board where a golfer stands to practice a set up position. A similar disclosure is presented in U.S. Pat. No. 5,108,106 which describes a golf set-up template. The golfer stands on the template and the ball is placed on a positioning arm for a straight shot, a slice or a hook shot.

Unfortunately, neither the PGA manual nor the other prior art disclosures provide instruction to assess individual anatomical differences in students nor are measurement standards presented to determine or instruct the proper set-up position where the conventional set-up is not optimum.

Thus, there is a need for a methodology and apparatus which measures and instructs golfers as to a proper alignment stance on an individual basis.

Furthermore, it would be advantageous to provide a methodology and apparatus for providing proper golf set-up alignment that is inexpensive and simple to use.

SUMMARY OF THE INVENTION

Briefly, in accordance with the invention, I provide an apparatus and methodology for providing proper set-up for a golfer. The methodology and apparatus set a golfer's hips parallel to his intended ball roll or flight line (target line) based upon his right or left hip rotation and shoulder width to determine his individualized stance address position to a golf ball.

The traditional golf instruction method for set-up to the golf ball, for putting through full swing, teaches golfers to assume a stance to the ball where the golfer's feet, hips and shoulders are parallel to the target line. Balance is emphasized as a critical variable in this stance to the ball. Contrary to conventional teaching, research shows that every golfer's hip rotation relative to his feet is different. Therefore, set-up to the golf ball will vary from one golfer to another dependent upon their personal anatomical structure as measured by their hips, not based upon teaching standards that are the same for all golfers. The inventor's research also shows that changes in stance width and forward and rearward movement of a golfer's feet alter the orientation of a golfer's hips providing the capability to adjust a golfer's feet, hips and shoulders to be parallel to the target line. The inventor's conclusion of this research is that a golfer's neutral, balanced set up is determined by the measured left or right rotation of his lower body (hip line) from a square stance and a stance that is shoulder width apart. When a golfer's hips are parallel to his target line, he is in balance. Every person's anatomical characteristics are different; therefore, each individual's prescribed stance set-up for balance is different.

The present invention corrects the imbalance found in most golfers by providing an apparatus and method for a golfer to determine the accuracy of a precise, prescribed, neutral balanced stance to the ball based upon two objective measures: 1) the width of the golfer's feet on the set-up template as related to his shoulder width measurement, and 2) the rotation of the golfer's hips relative to the intended target line. When the golfer's hips are parallel to the target line, the golfer's hips are considered square and the golfer is in balance.

To this end, the apparatus of the present invention includes a fixture, preferably in the form of a substantially straight elongate bar, that is affixed to a golfer's hips by a strap or the like. In addition, the apparatus includes a template "mat" placed on the ground which measures the width of a golfer's stance and rotation of a golfer's hips from the proposed path of the golf ball, also referred to as the "target line". The mat preferably includes a plurality of markings extending left to right across the template for measuring the width of a golfer's stance. In a preferred embodiment, the markings are provided in the form of numbers spaced at inch (or centimeter) intervals for identifying or measuring the spread of a golfer's stance. The mat also preferably includes a plurality of parallel lines extending left to right over the mat, parallel to the proposed target line, for measuring the relative rotation of a golfer's hips. To determine and align the golfer's stance, the method of aligning the golfer's stance preferably includes measuring the width of the golfer's shoulders to provide an initial estimate as to the golfer's expected stance width. The mat is positioned on the ground, with at least one mat line substantially parallel to the target line. The golfer is then positioned to stand on the mat with his feet adjacent to the mat line and his feet pointed substantially perpendicular to the mat line and with golfer's feet spaced approximately parallel to a proposed target line. The elongate bar is affixed to the golfer's hips with the bar positioned to extend substantially horizontally and parallel to the golfer's pelvis. Due to changes in anatomical structure, typically the bar will not be parallel to the mat line, which would reflect the optimum balance for the golfer. Instead, the golfer's body must be adjusted until the bar is parallel to the target line and mat line.

The golfer's body may be adjusted in various manners. In a first preferred embodiment, the golfer's hips are adjusted to be parallel to the target line by moving one of the golfer's feet forward or rearward. For the majority of golfers, the adjustment is made by moving the golfer's right foot or left foot back one inch, which results in the hips becoming parallel to the target line. To determine whether the hips have become parallel with the target line, the bar is viewed from above, preferably by another person such as a golf instructor, to determine whether it has become parallel to the mat lines parallel to the target line. In some instances, the golfer may have to move his left or right foot back two, three or more inches in order to have his hips become parallel to the target line.

In an alternative embodiment of the invention, the golfer adjusts the width of his stance in order for his hips to become parallel to the target line. Specifically, though it is preferred that the golfer places his feet at approximately the width of his shoulders, adjusting the width of his feet will cause rotation of most golfer's hips. Thus, adjusting the width of the golfer's stance, as an alternative or in conjunction with movement of the golfer's feet forward or rearward, can be useful in aligning the golfer's hips to be parallel to the target line.

In still an additional embodiment of the invention, the golfer's hips are adjusted to be parallel to the target line by rotating one of the golfer's feet outward, in other words flaring one of the golfer's feet. Preferably, flaring the golfer's feet is done in conjunction with moving one of the golfer's feet forward or rearward. Still additional adjustments to the golfer's body can be made to rotate the golfer's hips to a square position. For example, the golfer's grip of the golf club, flex in the golfer's knees, and angle of the golfer's back may adjusted to rotate the bar to parallel to the target line. However, in each case the bar is viewed from above to determine whether it has become parallel to the mat lines in order to confirm that the golfer has achieved a square stance.

Thus, it is an object of the present invention to provide an apparatus and method for measuring and correcting the rotation of a golfer's hips relative to the target line.

It is still an additional objective of the present invention to provide an apparatus and method for measuring the rotation of a golfer's hips relative to the target line which provides objective measurement.

It is still an additional objective of the present invention to provide an apparatus and method for correcting the rotation of a golfer's hips relative to the target line which is inexpensive and capable of being used with golf professionals and amateurs alike.

These, other and further objects and advantages of the invention will be apparent to those skilled in the art from the following detailed description thereof, taken in conjunction with the drawings.

DETAILED DESCRIPTION OF THE INVENTION

Figure 1:
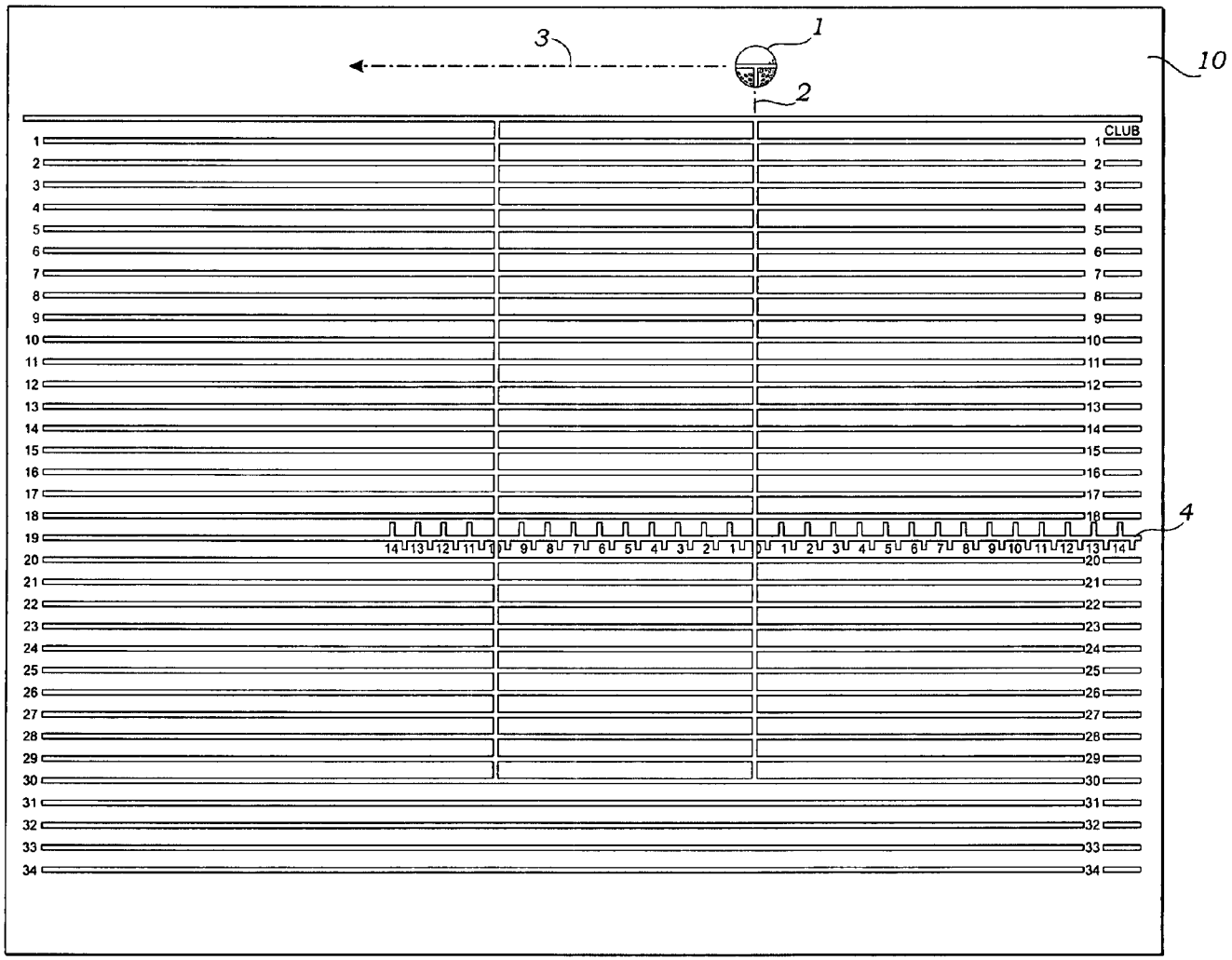
FIG. 1 is a top view of a template "mat" of the present invention.

While the present invention is susceptible of embodiments in various forms, as shown in the drawings, hereinafter be described the presently preferred embodiments of the invention with the understanding that the present disclosure is to be considered as an exemplification of the invention and it is not intended to limit the invention to the specific embodiments illustrated.

Figure 2:
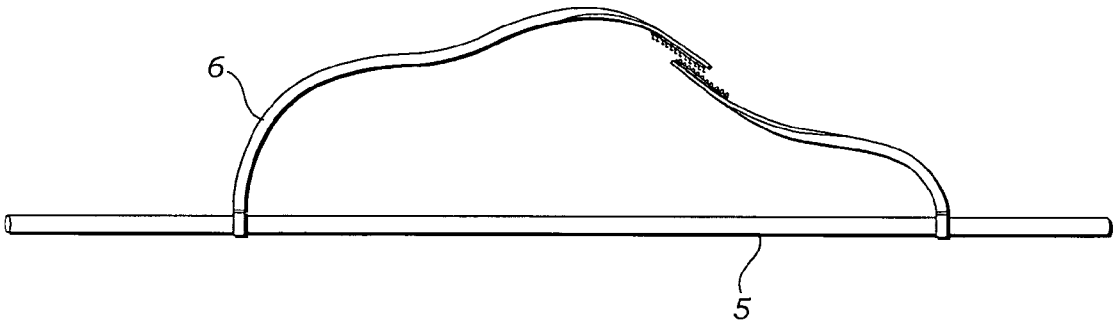
FIG. 2 is a perspective view of a preferred bar of the present invention that is placed flat against the front of the golfer's hips to determine hip rotation.

The system for aligning a golfer's stance provides an apparatus and method for a golfer 15 to set his hips parallel to his target line 3 through a measurement correction of right and left foot rotation, stance width, foot placement and precise foot flare. As shown in the figures, the system includes a fixture 5 which attaches to a golfer's hips and a mat which is placed on the ground for measuring and correcting foot placement and hip rotation. With reference to FIG. 2, the hip fixture of the present invention is preferably constructed in the form of a substantially straight bar which is attached to a golfer's hips using a cord or the like. The hip line indicator bar 5 can be made from a variety of materials including PVC pipe and wood. The cord 6 used to attach the hip line indicator bar 5 (FIG. 2) can be made from a variety of materials including elastic, rope or rubber. When the hip line indicator bar 5 is attached to the golfer's hips, it is adjusted so that it fits snugly on the upper hips below the golfer's belt line and parallel to the ground.

In addition, as shown in FIG. 1, the apparatus includes a template 10, also referred to herein as a mat, which is placed on the ground to measure the width of a golfer's stance and to measure the rotation of a golfer's hips from the "target line". The mat 10 preferably includes a plurality of marking extending left to right across the template for measuring the width of a golfer's stance and plurality of parallel lines 4 extending left to right over the template 10 for measuring the rotation of a golfer's hips. The practice template 10 (FIG. 1) can also be made from a variety of materials including vinyl, cloth, artificial grass, etc, so as to provide a practice surface upon which a golfer stands to hit balls. The practice mat can also be integrated into the ground surface such as by painting the template directly onto a walking or golf practice surface. The template 10 has lines positioned horizontally one (1) inch apart with one (1) primary vertical line 2. Preferably, an image of a golf ball 1 is provided at the top of the mat 10 which the golfer addresses with a club when he practices on the template 10. The single primary vertical line 2 preferably passes through and identifies the center of the golf ball. The numbered horizontal lines are one (1) inch apart and represent the lines parallel to the golfer's target line 3. In a preferred embodiment, on the nineteenth (19th) horizontal line 4, a zero (0) point marks the intersection of the vertical line 2 that identifies the center of the ball and the nineteenth (19th) line 4 of the horizontal lines. Furthermore, preferably the mat includes markings extending left to right across the mat for identifying and measuring the width of the golfer's stance. As shown in the drawings, preferably, the mat includes markings in the form of numbers one (1) through fourteen (14) to the right of the zero (0) point and numbers one (1) through fourteen (14) to the left of the zero (0) point. Preferably, the numbers are placed at one (1) inch intervals across the line. This numbered horizontal line 4 provides a measuring tool on which the golfer can set his stance width (FIGS. 3, 4, 12 and 13) and check his hip rotation and to verify accurate stance width (FIG. 4) when he practices his set up. The zero (0) point on this line 4 represents the golfer's ball position in his stance.

Figure 3:
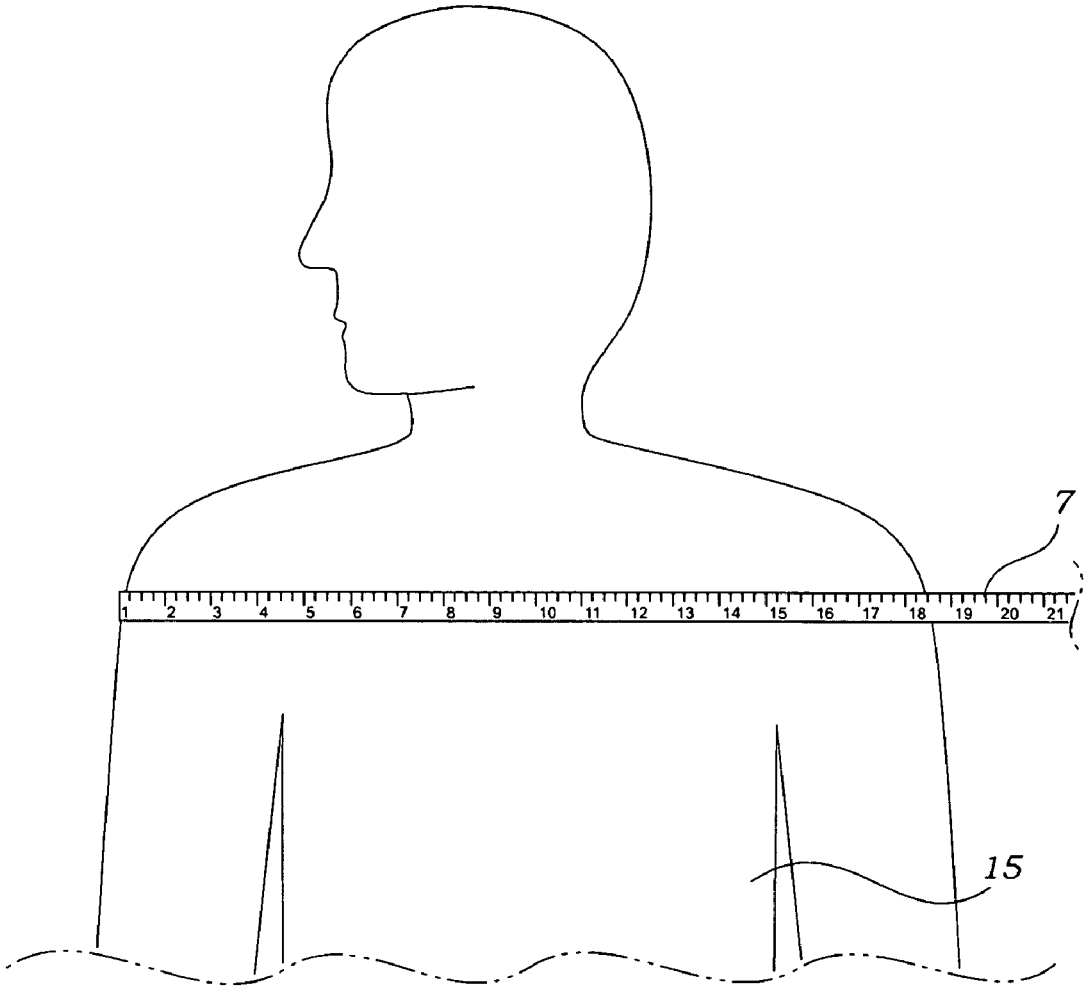
FIG. 3 is a perspective view illustration measurement of a golfer's shoulder width.
Figure 4:
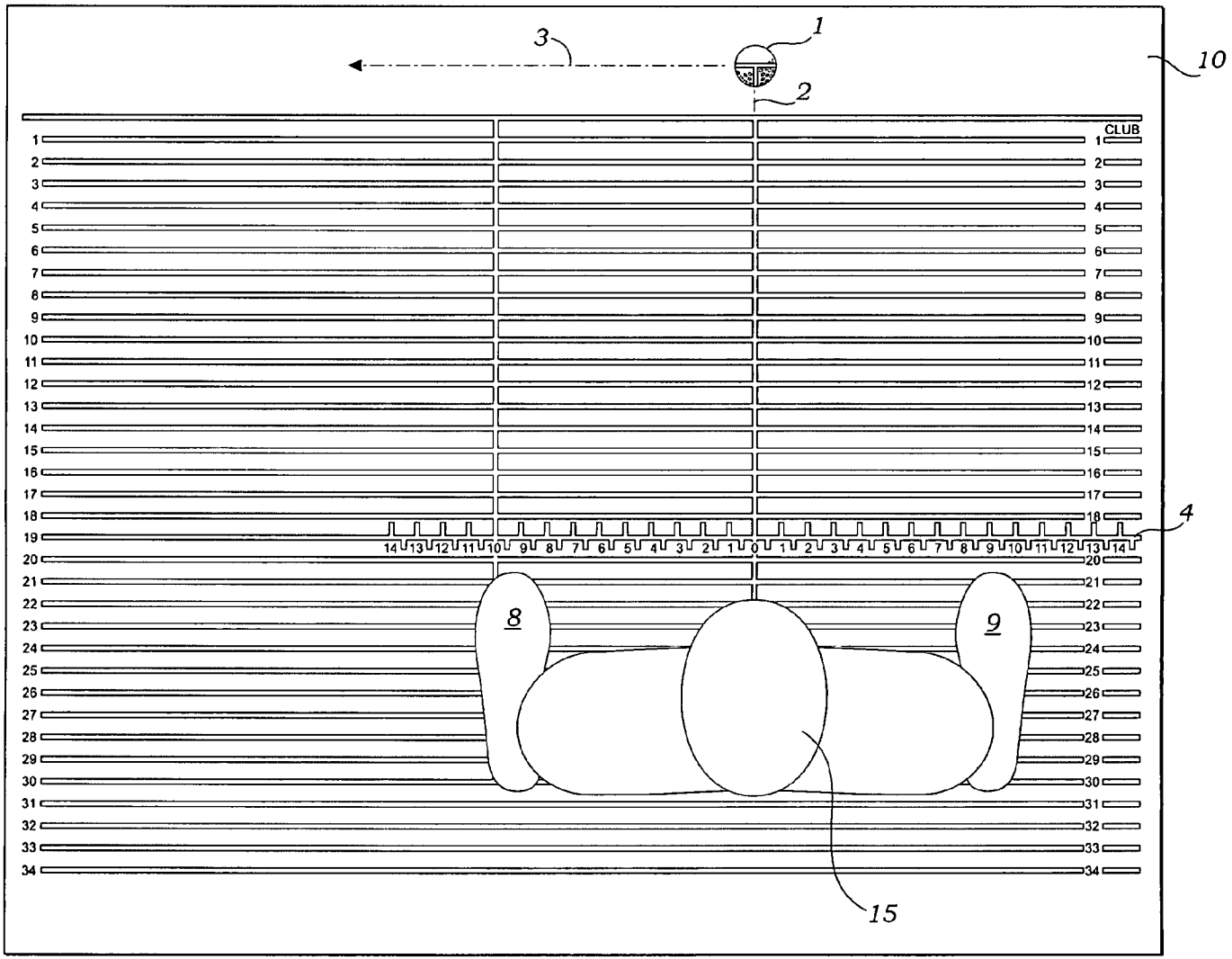
FIG. 4 is a top view of a golfer setting his stance width the same as his shoulder width on the set-up template.
Figure 6:
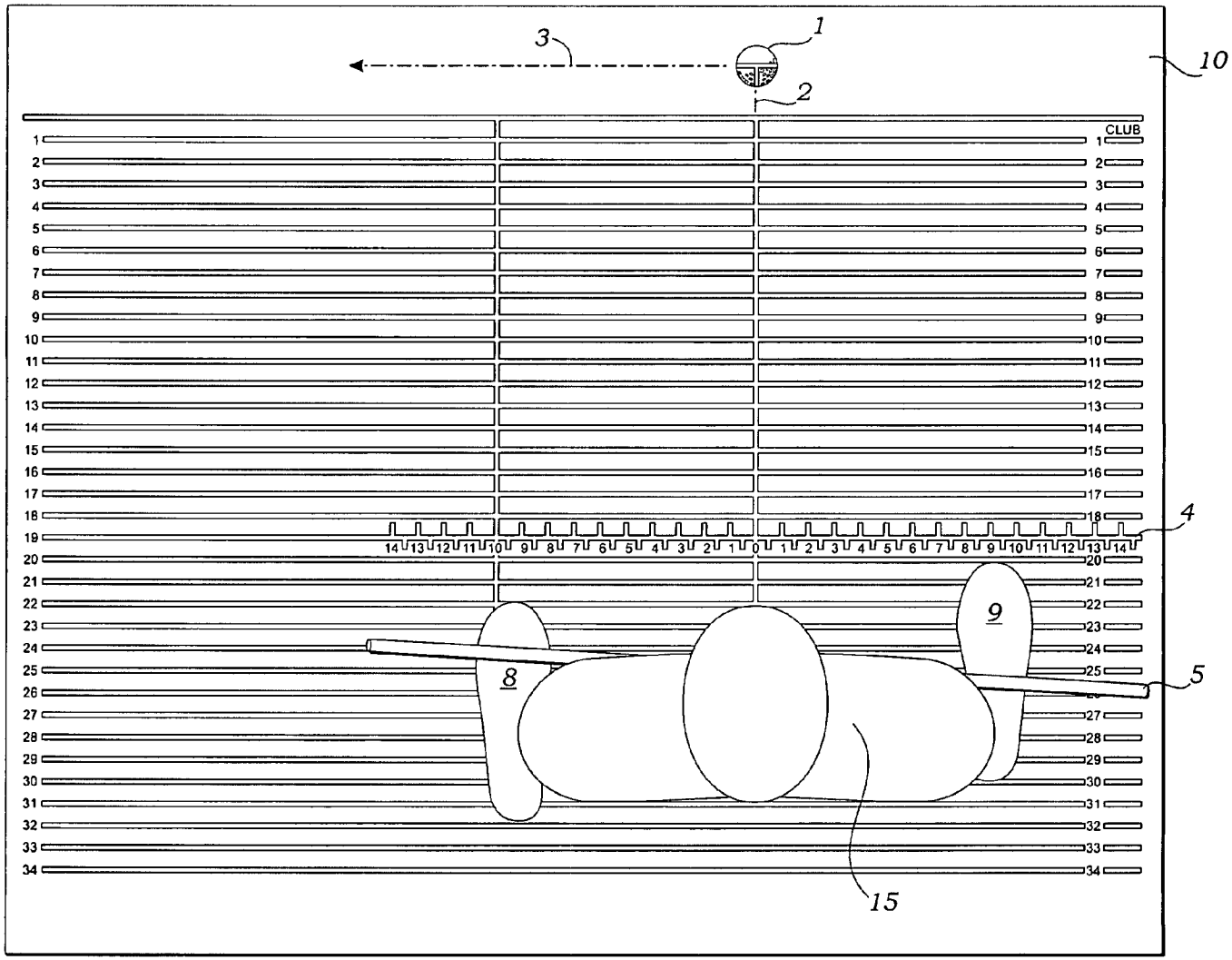
FIG. 6 is a top view of the golfer shown in FIG. 5 standing tall on the set-up template with his feet shoulder width apart and having a two (2) inch open stance where his right foot is two inches closer to the target line than his left foot.

To practice the present invention, as shown in FIG. 3, preferably the golfer's shoulder width is measured using a tape measure or the like. The golfer's shoulders are measured from the outside edge of one shoulder, across the middle of the golfer's upper chest to the outside edge of his other shoulder. As an example, FIG. 3 shows a golfer's shoulder width as 18½ inches as measured by a numbered ruler 7. As shown in FIG. 4, the golfer then stands on the template 10 with both feet 8 and 9 shoulder width apart, 90 degrees to the target line 3 and with no flare in either foot 8 and 9. As shown in FIG. 4, for the golfer having shoulder width measured in FIG. 3, the middle of the golfer's right foot 9 is 9¼ inches from the zero (0) point on line nineteen (19) 4 to the right with his right foot 9 ninety (90) degrees to his target line 3. Correspondingly, the middle of the golfer's left foot 8 is 9¼ inches from the zero (0) point to the left on line nineteen (19) 4 with his left foot 8 ninety (90) degrees to his target line 3 (FIG. 4.) Both of the golfer's feet are positioned on line twenty (20) of the template 10 in preparation for hip line measurement (FIG. 4.) This is the golfer's stance width before adjusting the line position of either foot 8, 9 or flaring his right 9 or left 8 foot (FIG. 6.)

Figure 5:
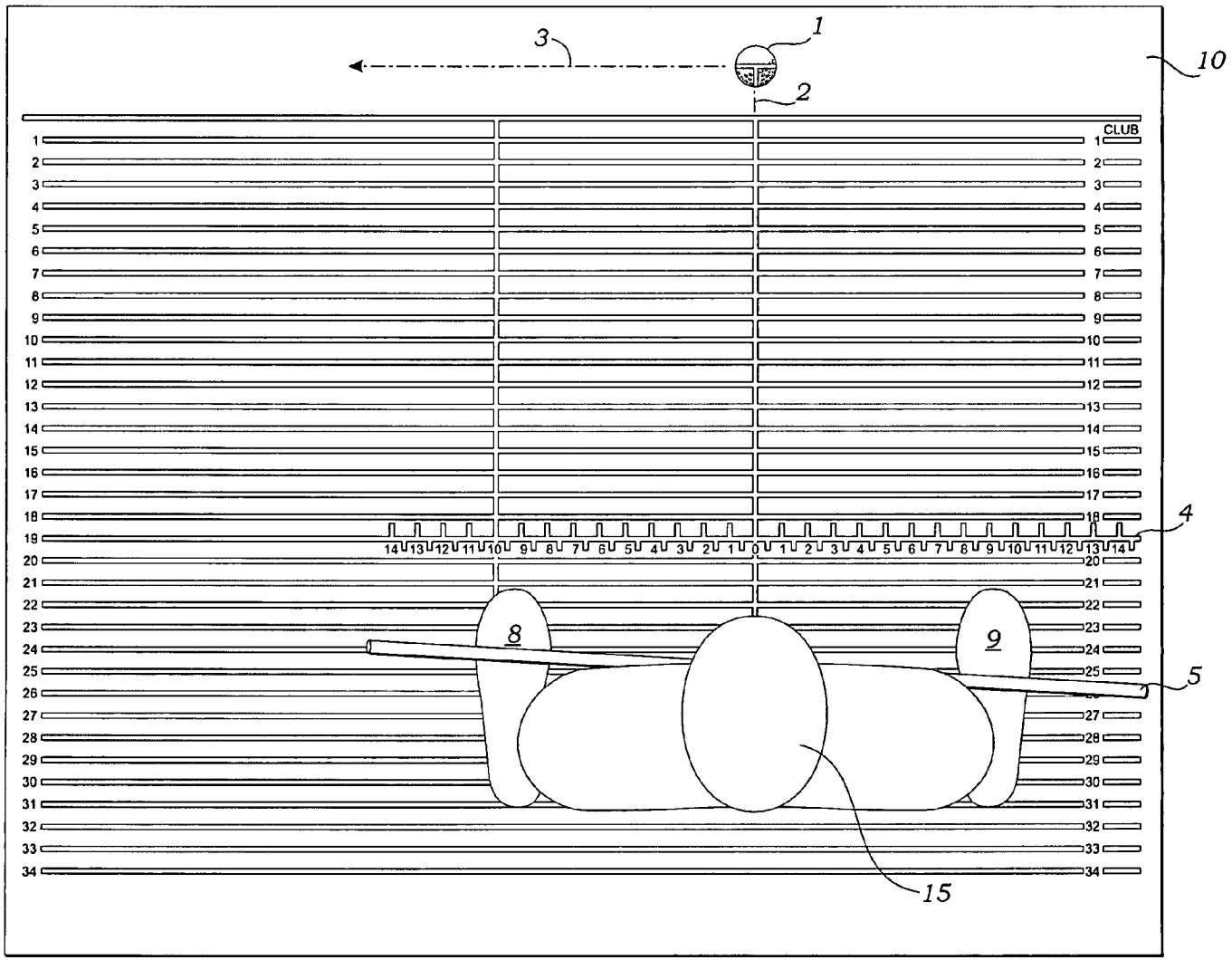
FIG. 5 is a top view of a golfer using the hip line indicator bar attached to the golfer's hips with an elastic cord while he stands on the set-up template.
Figure 8:
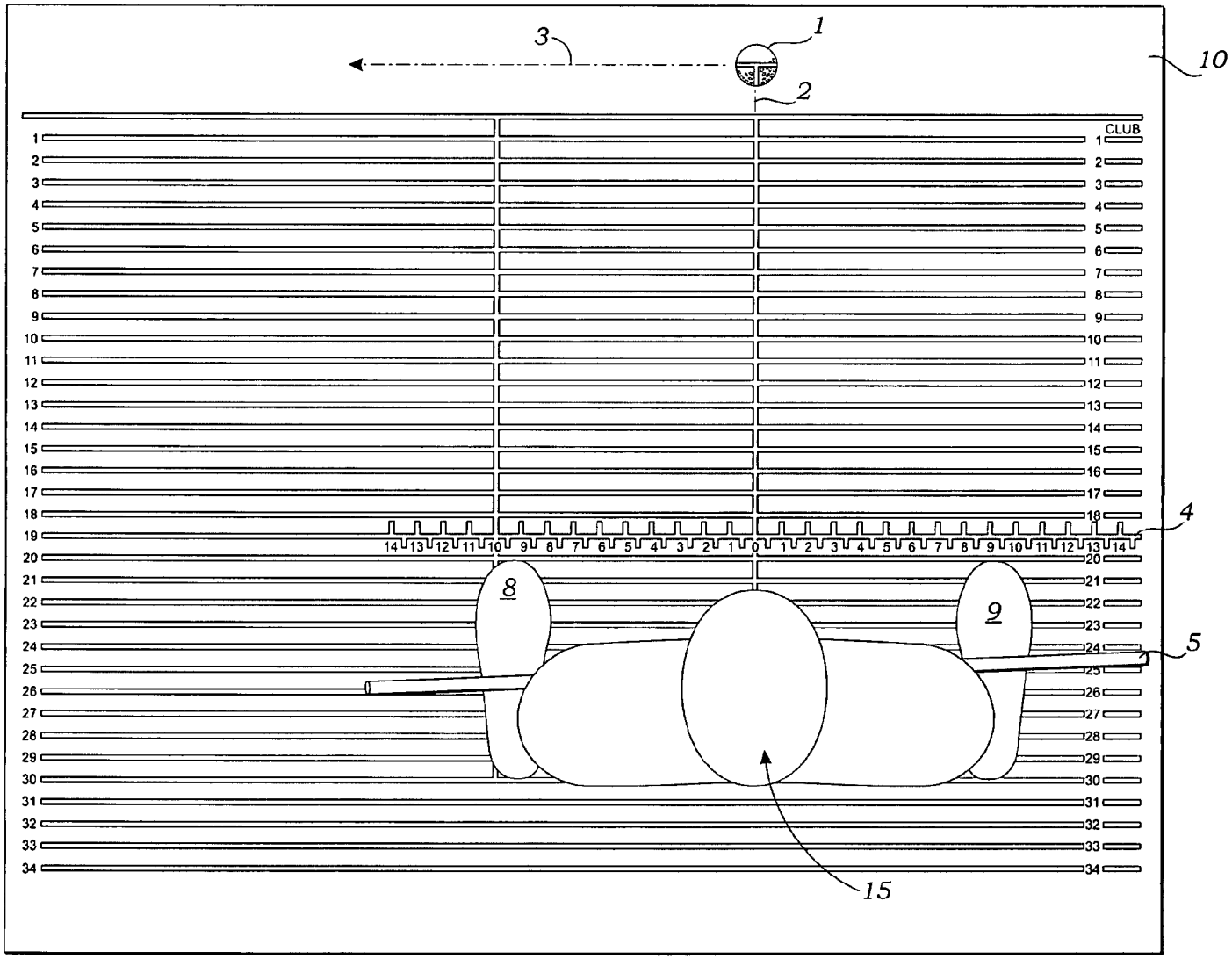
FIG. 8 is a top view of a golfer standing tall on the set-up template with his feet shoulder width apart and with his hips rotated left (open hip line) approximately two (2) inches.

The hip line indicator bar 5 is attached to the golfer's hips using an elastic cord 6. The golfer is asked to stand tall, close his eyes, take a deep breath and relax his hips and shoulders. From this relaxed position, the golfer's hips will always rotate right (as shown in FIG. 5), left (as shown in FIG. 8,) or remain parallel (square) to the target line 3. It is from the hip rotation, and corresponding indicator bar rotation, that one determines the golfer's proper individualized set up to the ball.

To determine the rotation of the indicator bar relative to the target line, the indicator bar is viewed from above and its alignment is compared to the parallel lines extending across the template. If the bar is not parallel to the mat lines, the golfer's hips are determined to not be square.

Figure 7:
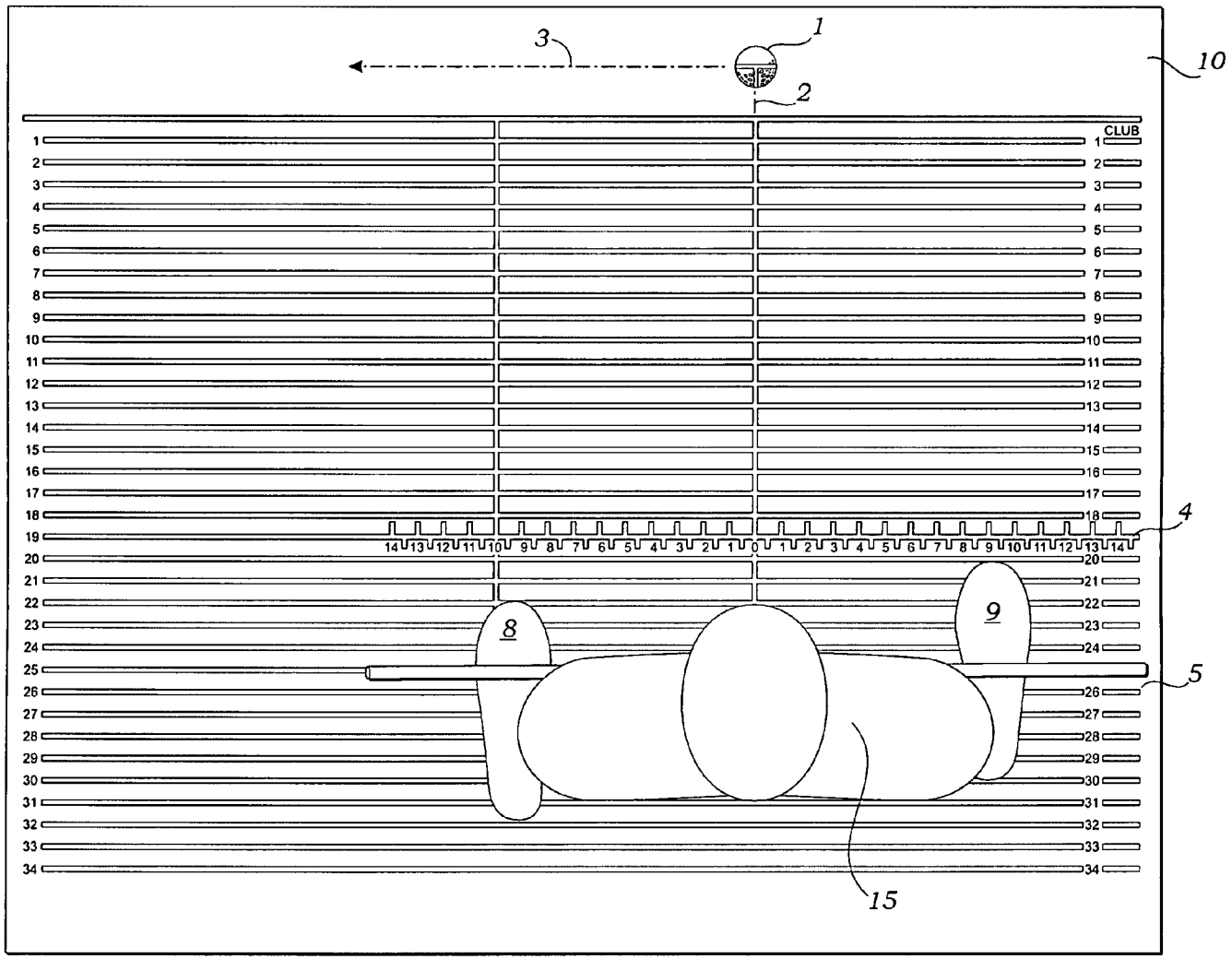
FIG. 7 is a top view of the golfer shown in FIGS. 5 and 6 on the set-up template with a slight flare of his left foot and the hip line indicator bar showing that the golfer's hips are parallel to the lines on the set-up template and his target line.
Figure 9:
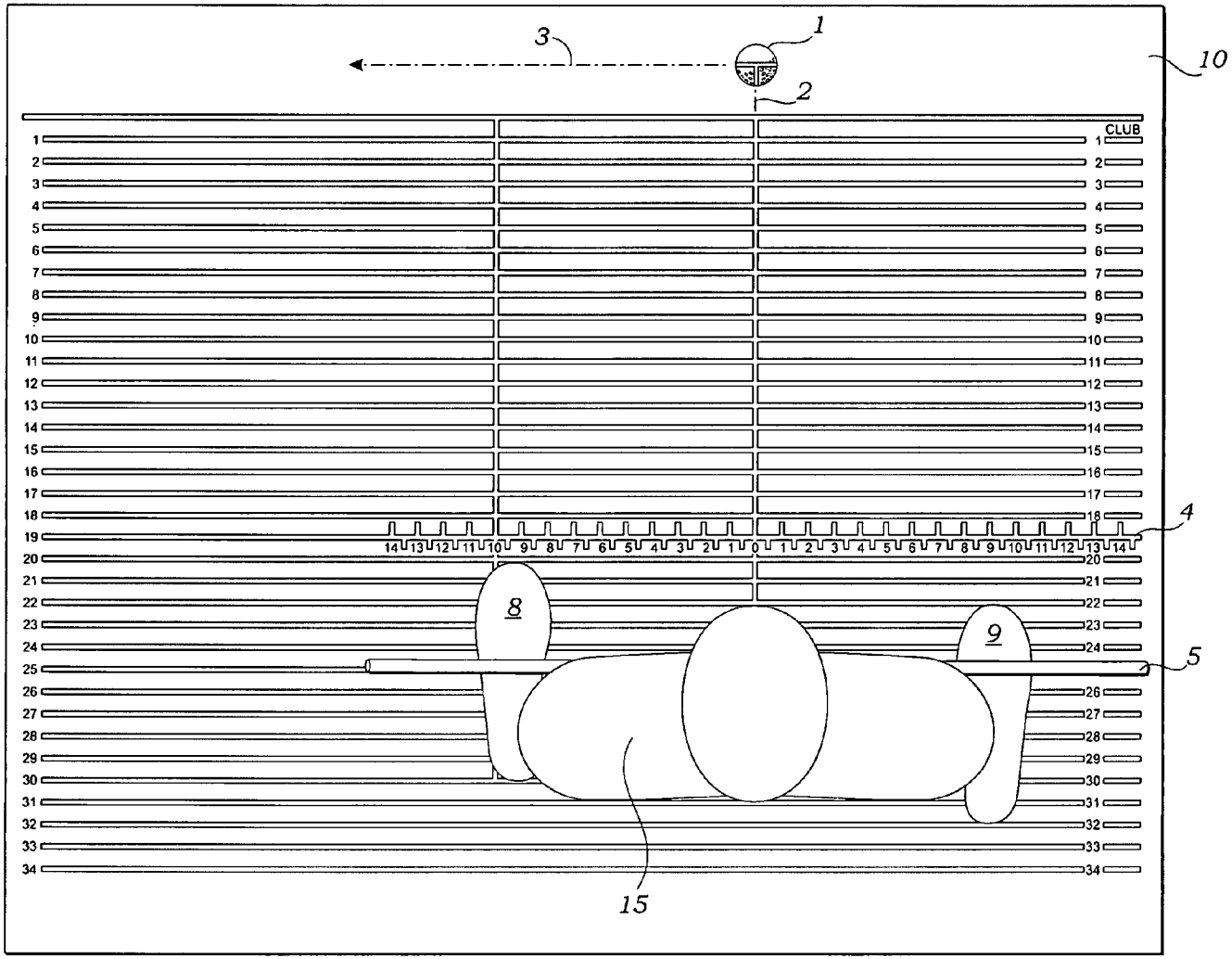
FIG. 9 is a top view of the golfer shown in FIG. 8 where his right foot is slightly flared and two (2) inches behind his left foot, and correcting the golfer's hips to be parallel the target line 3 as indicated by the hip line indicator bar.
Figure 10:
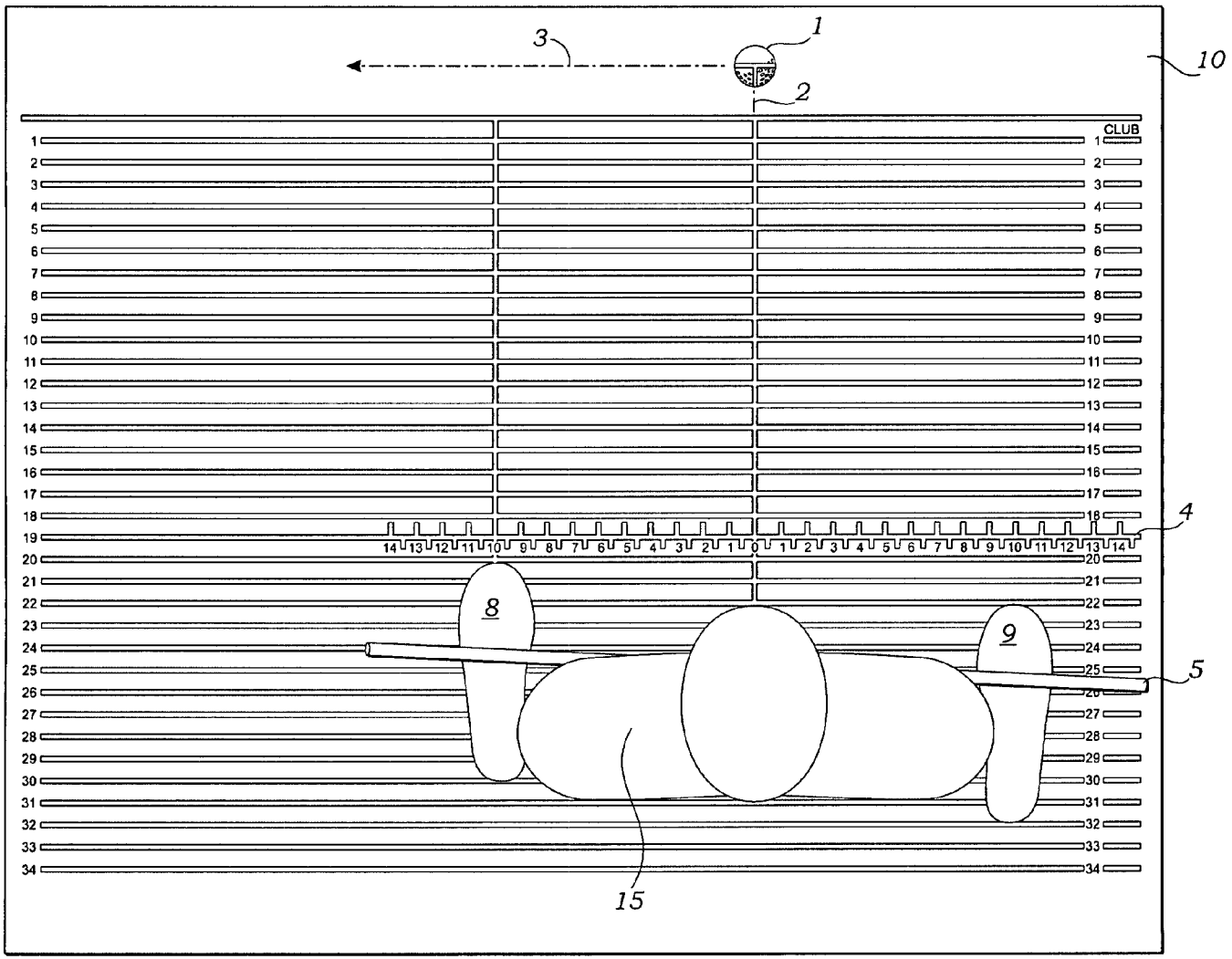
FIG. 10 is a top view of the golfer shown in FIG. 9 except that his stance width is one (1) inch wider causing the golfer's hip to rotate to the right (closed position)
Figure 11:
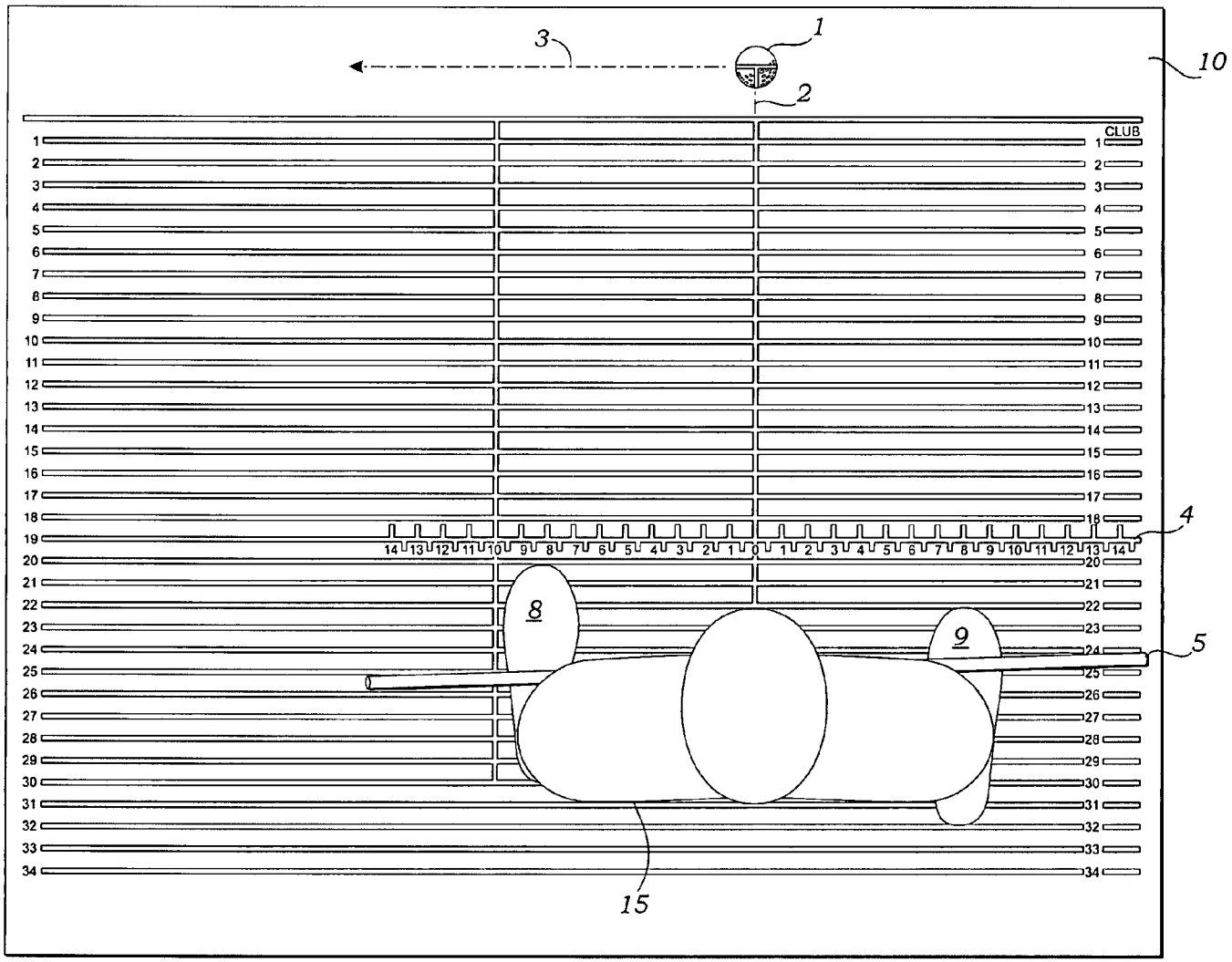
FIG. 11 is a top view of the golfer shown in FIG. 9 except that his stance width is one (1) inch narrower causing the golfer's hip to rotate to the left (open position)

If the golfer's hips are not square, the golfer's stance is adjusted in one (1) inch increments and his left 8 or right foot 9 is slightly flared or not at all (FIGS. 12 and 13) depending on the prescribed stance line, until his hips are parallel to his target line as illustrated in FIGS. 7 and 9. For the majority of golfers, the stance adjustment requires moving the right 9 or left foot 8 straight back one (1) inch to set his hips parallel to the target line 3. Some golfers need to pull their left 9 or right foot 8 back more than one (1) inch to set their hips parallel to the target line 3, as shown in FIGS. 7, 9, 12 and 13.

Figure 12:
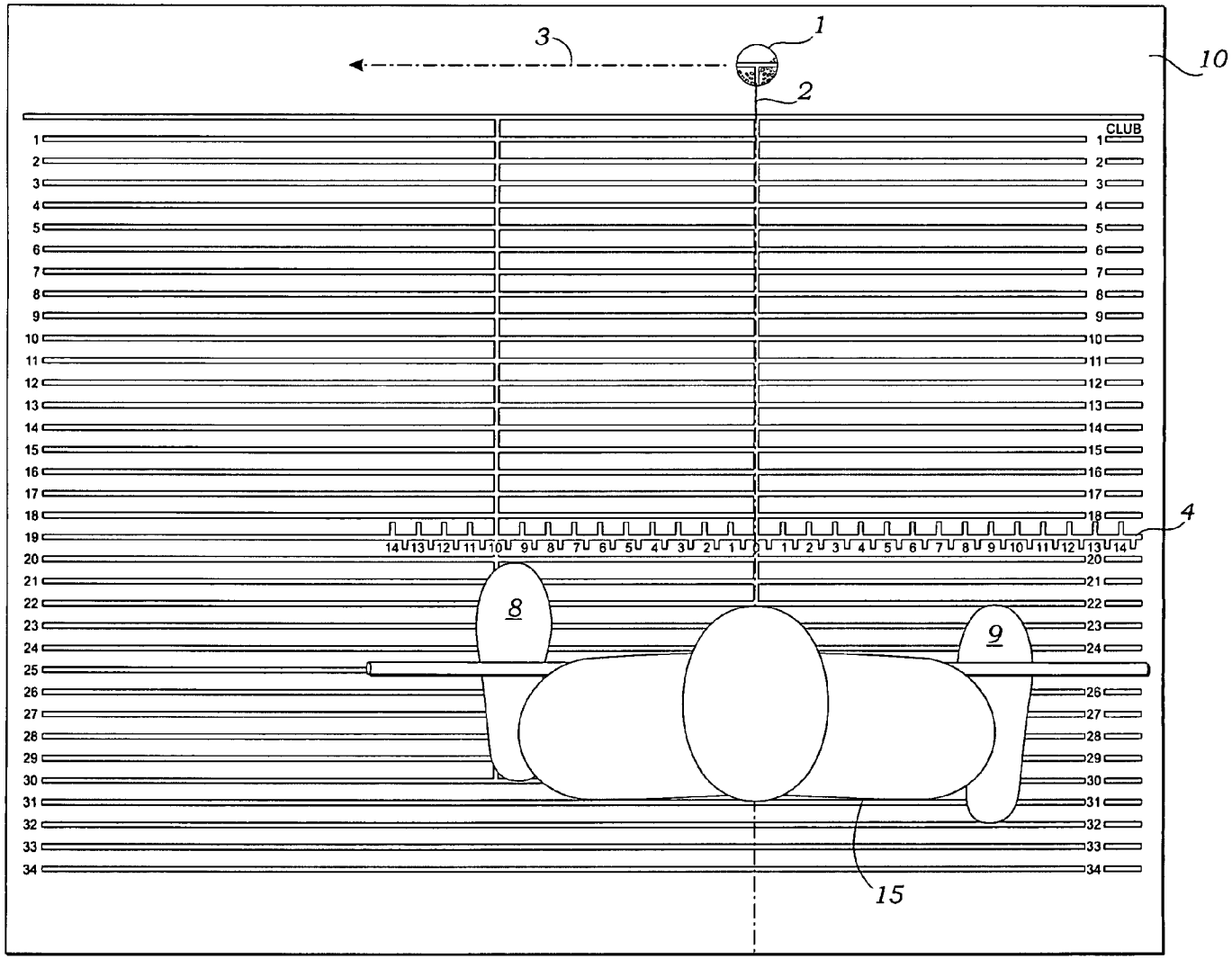
FIG. 12 is a top view of the golfer shown in FIG. 5 with his feet shoulder width apart and his right foot two (2) inches rearward resulting in his hip line parallel to the target line.
Figure 13:
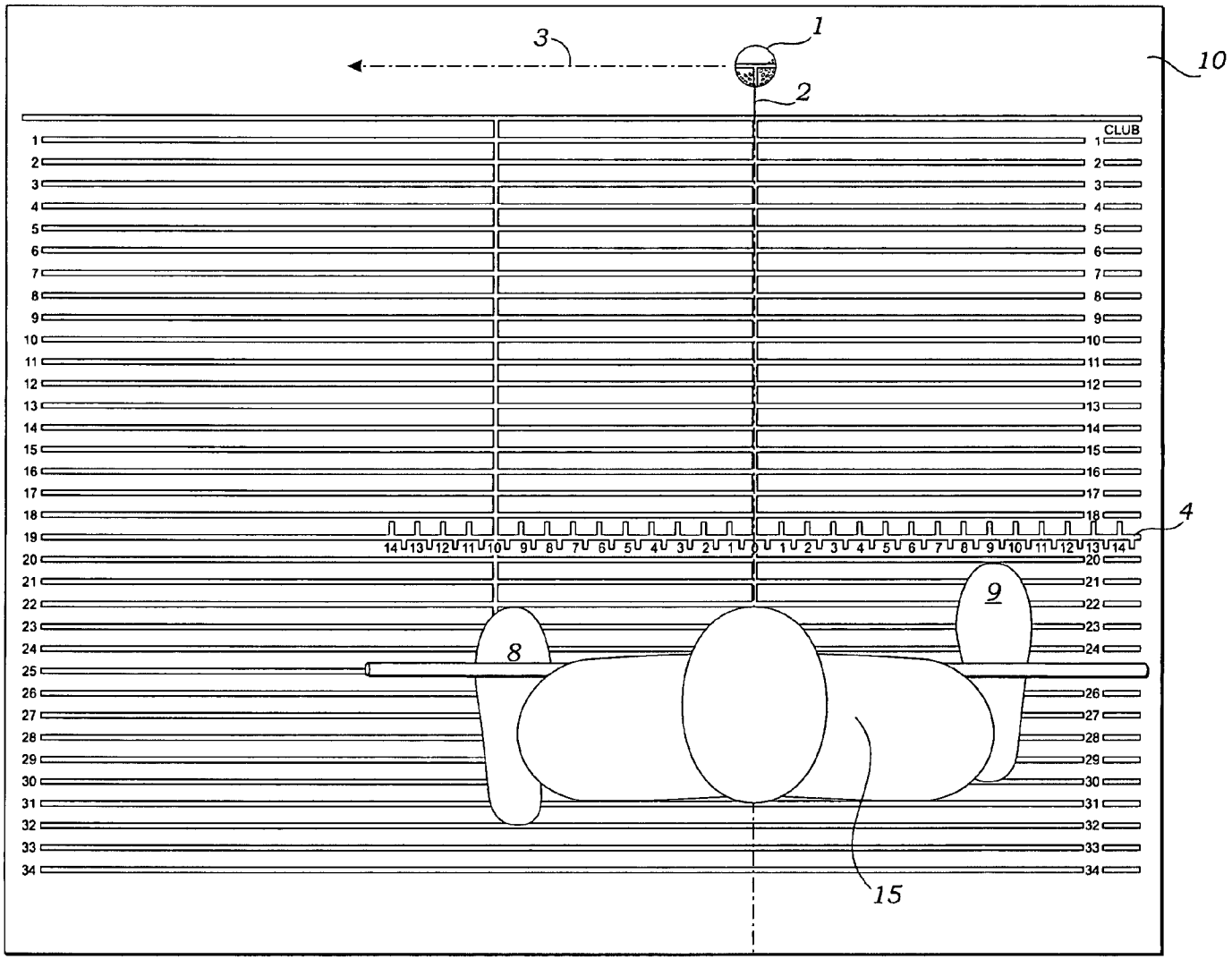
FIG. 13 is a top view of the golfer shown in FIG. 8 with his feet shoulder width apart and his left foot two (2) inches rearward of his right foot resulting in his hip line parallel to the target line.

Preferably, the foot that is moved back is always flared (FIGS. 7 and 9) except when squaring the hips in the procedures shown in FIGS. 12 and 13. If foot flare is indicated, the golfer assumes his prescribed stance width first (FIGS. 3 and 4) prior to flaring either foot 8 or 9. This slight flare is not considered an increase in stance width. The slight flaring of the golfer's feet shown in FIGS. 7 and 9 is the final move that squares his hips to his target line 3. The squaring of the hips with the slight flare of the foot that is further from the target line 3 is visually observed with the hip line indicator bar 5. Until the flare is initiated, the hip line indicator bar 5 shows right or left hip rotation as shown in FIG. 6. Upon slightly flaring the foot that is moved straight back, the hip line indicator bar 5 moves parallel to the golfer's target line 3 (FIGS. 7 and 9.)

When the hip line indicator bar 5 is set parallel to the golfer's target line 3 with the golfer's stance shoulder width apart, this is the golfer's ideal stance set up to the golf ball (FIGS. 7 and 9.) Any variation from this position at address without exact compensations results in the golfer's hip line rotating left or right of his target line 3 (See FIGS. 5, 6, 8, 10 and 11.). As an example, a right handed golfer whose hip rotation is two (2) inches to the left (FIG. 8) when his hips are measured in a shoulder width stance (FIGS. 3 and 4) with his feet ninety (90) degrees to the same horizontal line 4 on the template 10 (FIG. 1) would set his hip line parallel to his target line 3 as follows:

With reference to FIGS. 4 and 8, the golfer sets his feet 8, 9 shoulder width apart on line twenty (20) of the set up template 10. His right foot 9 is moved two (2) inches straight back so that it is two (2) inches further from his target line 3 than his left foot 8 with his stance remaining the same as his shoulder width. Then, the golfer slightly flares his right foot 9 as his left foot remains ninety (90) degrees to his target line 3 (FIG. 9.) If the golfer does not flare the foot that is pulled straight back from his target line 3, his hip line will tend to remain rotated left or right (as shown in FIG. 6). The slight flare of his right foot 9, as shown in FIG. 9, sets the golfer's hip line parallel to his target line 3. The hip line indicator bar 5 is used so the golfer can adjust his set up until the bar 5 is parallel to his target line 3.

This same golfer whose hips rotate two (2) inches left (FIG. 4) when his hips are measured can also set his hips parallel to the target line 3 by pulling his left foot 8 straight back two (2) inches from the target line (FIG. 13) without any flare of either foot.

As another example shown in FIG. 5, a right handed golfer whose hip rotation is two (2) inches to the right (when measured from a standing tall position with feet shoulder width apart on the same horizontal line of the template) can adjust his hip lines parallel to the target line 3 as follows. The golfer sets his feet 8, 9 shoulder width apart (FIGS. 3 and 4) on line twenty (20) of the template 10 as shown in FIG. 5. His left foot 8 is then moved straight back two (2) inches behind his right foot 9. His feet 8, 9 are kept at shoulder width apart while his left foot 8 is slightly flared (See FIG. 7.). As a result of these corrections, the golfer's hips and bar 5 become parallel to his target line 3. Typically, if the golfer does not flare his left foot 8, his hip line will remain rotated right, as shown in FIG. 6. Accordingly, the golfer preferably flares his left foot 8 as he keeps his right foot 9 perpendicular to his target line 3 resulting in his hips becoming parallel to his target line 3. The hip line indicator bar 5 attached to the golfer's hips identifies the amount of left foot flare to position the golfer's hips parallel to his target line 3 (FIG. 7). Once the hip bar 5 becomes parallel to the target line, the amount of foot flare is determined and maintained. With reference still to FIG. 5, the same golfer whose hips rotate two (2) inches right when his hips are measured can also set his hips parallel to the target line 3 by pulling his right foot straight back two (2) inches from the target line as reflected in FIG. 12.

The above described illustrations of a golfer's hips being rotated two (2) inches left (FIG. 8) and two (2) inches right (FIG. 5) are for the purposes of illustration only. The majority of golfers can achieve parallel hip position by making an adjustment of only one (1) inch. The individual ideal set up is different for every golfer. Once the golfer has determined his correct stance, including feet placement, the golfer practices addressing the ball, and checks his stance line and stance width to determine if he is in his prescribed balanced stance set-up. Preferably, the golfer practices his prescribed set-up using the template 10 (FIG. 1) and hip line indicator bar 5 (FIG. 2) as confirmation that his hips are set parallel to his target line 3.

Although the present invention has been described with reference to the preferred embodiments, those skilled in the art will recognize that changes may be made in form and detail without departing from the spirit and scope of the invention. Thus, the present invention is intended to be limited only to the following claims.

I claim:

1. A method of aligning a golfer's stance comprising the steps of:

affixing an elongate fixture to the golfer substantially adjacent to the golfer's hips, the fixture positioned to extend substantially horizontally and parallel to the golfer's pelvis to provide a visual indication of the golfer's hip rotation;

providing a mat including at least one mat line substantially parallel to a proposed target line;

positioning the golfer on the mat with his feet adjacent to the mat line and his feet pointing substantially perpendicular to the line;

visually comparing the position of the elongate fixture to the mat line to determine if the elongate fixture and mat line are parallel; and adjusting parts of the golfer's body until the fixture is parallel to the mat line.

2. The method of aligning a golfer's stance of claim 1 wherein the step of adjusting parts of the golfer's body includes rotating one of the golfer's feet.

3. The method of aligning a golfer's stance of claim 1 wherein the step of adjusting parts of the golfer's body includes moving one of the golfer's feet forward or backward.

4. The method of aligning a golfer's stance of claim 1 further comprising the steps of:

adjusting the golfer's shoulders to ensure that the shoulders are substantially parallel to the line.

5. The method of aligning a golfer's stance of claim 4 wherein the step of adjusting parts of the golfer's body includes moving one of the golfer's feet forward or backward.

6. A method of aligning a golfer's stance comprising the steps of:

providing a mat including at least one straight mat line substantially parallel to the target line;

affixing an elongate fixture to the golfer substantially adjacent to the golfer's hips, the fixture positioned to extend substantially horizontally and parallel to the golfer's pelvis to provide a visual indication of the golfer's hip rotation;

positioning the golfer on the mat with his feet adjacent to the mat line and with his feet pointing substantially perpendicular to the mat line;

positioning the golfer in a golf stance including the target line reflecting the intended direction of travel for the golf ball, the golfer is positioned to address a golf ball with a golf club;

visually comparing the position of the elongate fixture to the mat line to determine if the elongate fixture and mat line are parallel; and adjusting parts of the golfer's body until the fixture is parallel to the mat line.

7. The method of aligning a golfer's stance of claim 6 wherein the step of adjusting parts of the golfer's body includes rotating one of the golfer's feet.

8. The method of aligning a golfer's stance of claim 6 wherein the step of adjusting parts of the golfer's body includes moving one of the golfer's feet forward or backward.

* * * * *